US005105174A

United States Patent [19]

Cruchon et al.

[11] Patent Number: 5,105,174

[45] Date of Patent: Apr. 14, 1992

[54] WAVE-GUIDE BAND REJECTION FILTER HAVING A SHORT CIRCUITED COAXIAL TUNING SCREW

[75] Inventors: Jean-Claude Cruchon, Bouffemont; Jean-Denis Schubert, Verneuil Sur Seine, both of France

[73] Assignee: Alcatel Transmission Par Faisceaux, Hertziens, France

[21] Appl. No.: 619,643

[22] Filed: Nov. 29, 1990

[30] Foreign Application Priority Data

Nov. 30, 1989 [FR] France ..... 89 15805

[51] Int. Cl.[5] ..... H01P 1/207

[52] U.S. Cl. ..... 333/209; 333/232; 333/235

[58] Field of Search ..... 333/202, 208–212, 333/227, 225, 226, 230–233, 235, 253

[56] References Cited

U.S. PATENT DOCUMENTS

| | | | |
|---|---|---|---|
| 2,645,679 | 7/1953 | Reade | 333/209 |
| 3,876,963 | 4/1975 | Graham | 333/208 X |
| 4,035,749 | 7/1977 | Slocum et al. | 333/232 |
| 4,380,747 | 4/1983 | Curtinot et al. | 333/209 X |
| 4,746,883 | 5/1988 | Sauvage et al. | 333/210 X |
| 4,752,753 | 6/1988 | Collins et al. | 333/209 |
| 4,780,693 | 10/1988 | Elliott et al. | 333/208 X |

FOREIGN PATENT DOCUMENTS

| | | | |
|---|---|---|---|
| 2808369 | 9/1979 | Fed. Rep. of Germany | 333/210 |
| 2326077 | 4/1977 | France | 333/212 |
| 0843341 | 8/1960 | United Kingdom . | |

OTHER PUBLICATIONS

Review of the Electrical Communication Laboratories, vol. 18, No. 7/8, Jul. 1970, Tokyo, Japan, pp. 493—511; H. Sugahara et al.: "Small-sized channel branching filter for microwave".

*Primary Examiner*—Eugene R. LaRoche
*Assistant Examiner*—Seung Ham
*Attorney, Agent, or Firm*—Sughrue, Mion, Zinn Macpeak & Seas

[57] ABSTRACT

A band rejection filter for a microwave wave-guide formed of a wave-guide (11) and at least one short-circuited coaxial line. An inner conductor (17) and an outer conductor (19) are coaxial with the inner conductor (17) being a conducting rod extending a screw (12) and the outer conductor being at least in part a tapped hole (19) formed in the wall of the wave-guide (11). The screw (12) forms an adjustable short-circuit. The short-circuited coaxial line has a length slightly less than an odd multiple of a quarter wavelength corresponding to the central frequency of the frequency band to be rejected, so as to form an inductive susceptance. The end of the inner conductor (17) projects slightly into the wave-guide (11) to form a capacitive susceptance which is connected to the end of the coaxial line so as to form a resonator tuned to the central frequency of the band to be rejected.

6 Claims, 4 Drawing Sheets

WAVE-GUIDE BAND REJECTION FILTER HAVING A SHORT CIRCUITED COAXIAL TUNING SCREW

FIELD OF THE INVENTION

The invention relates to a band rejection filter for a microwave wave-guide. In a microwave transmission system, it is often necessary to attenuate one frequency band without attenuating an adjacent frequency band. For example, in a transmission-reception head, separation of the transmitted waves and the received waves is ensured by a frequency difference and by crossing of the polarizations, but is is nevertheless necessary to attenuate the transmitted waves arriving at the receiver, so as to avoid saturation, undesirable beat, etc.. phenomena.

BACKGROUND OF THE INVENTION

It is known to form a band rejection filter from at least one resonating cavity coupled to a wave-guide by an iris. To attenuate sufficiently the frequency band to be rejected, it is conventional to increase the number of cavities coupled to the guide section. These cavities are separated by an uneven number of quarter wavelengths corresponding to the central frequency of the band to be let through without attenuation. When the guide has a rectangular section, the cavities are disposed on at least one of the large sides of the guide, and possibly on both sides, for increasing the number of cavities while minimizing the size. However, this type of band rejection filter is very cumbersome and costly. It is therefore particularly ill fitted for constructing low capacity stations, which have to be of a low cost, and in which it is desirable to integrate in a single case the microwave transmission device and the reception device.

SUMMARY OF THE INVENTION

The object of the invention is to provide a band rejection filter for wave-guides, whose construction is inexpensive and whose size is sufficiently small for it to be integrate in a transmission-reception head of a low capacity station. The object of the invention is a band rejection filter having at least one resonator formed of an inductive susceptance element and a capacitive susceptance element, which require little space and are easy to construct, the first being formed of a short-circuited coaxial line and the second being formed of a conductor of short length plunging into the wave-guide, and which extends the central conductor of the line.

According to the invention, a band rejection filter for a microwave wave-guide, comprising:

a wave-guide;

at least one short-circuited coaxial line comprising an inner conductor and an outer conductor which are coaxial, the inner conductor having a length equal to an odd multiple of a quarter wavelength corresponding to the central frequency of a frequency band to be rejected, and plunging into the wave-guide section for being coupled to the electric field, and the outer conductor having a length less than said multiple, is characterized in that said outer conductor is formed, at least partially, by a cylindrical tapped hole formed in a wall of the wave-guide and whose electric length is adjustable by a short-circuit element which can be screwed into said tapped hole.

In a first embodiment of the filter according to the invention, the inner conductor comprises a metal screw, screwed into the tapped hole, this screw comprising a cylindrical extension having the same axis of symmetry of revolution as the screw but with a smaller diameter. The portion of the tapped hole which is not occupied by the screw forms an outer conductor for the coaxial line, whereas the extension of the screw forms an inner conductor, and the screw itself forms a short-circuit element at the end of the coaxial line.

This embodiment is very simple, for it is sufficient to modify a conventional brass screw, by removing metal on a lathe so as to form an extension having a length equal to an odd multiple of quarter wavelengths corresponding to the central frequency of the frequency band to be rejected.

In another embodiment, the short-circuited coaxial line comprises a cylindrical externally threaded socket, smooth on the inside, which is closed at one end by a conducting plane forming a short-circuit element and carrying a coaxial cylindrical conductor forming the inner conductor. The socket is screwed into the tapped hole.

This embodiment is slightly more complex for such a socket cannot be manufactured by modifying a screw. However, it has the advantage of allowing a wave-guide section to be used with thinner walls.

The two embodiments have the advantage of being less costly and less cumbersome than conventional filters, for a given number of resonators.

The invention will be better understood and other characteristics will be clear from the following description and the accompanying figures:

DESCRIPTION OF THE PREFERRED EMBODIMENTS

It is known that a metal bar inserted a short way into a wave-guide has a capacitive susceptance which increases with the inserted distance, becomes infinite and changes sign when inserted substantially by a quarter wavelength. Beyond this value, the susceptance is inductive and decreases until the bar touches the wall of the wave-guide which is opposite the wall through which the bar is inserted.

Figure 1:
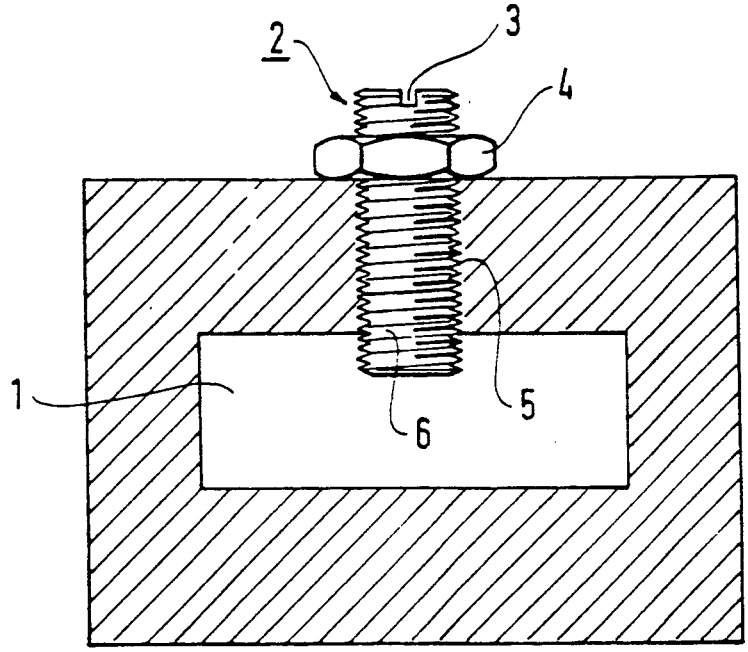
FIG. 1 PRIOR ART
FIGS. 1 and 2 illustrate the operation of the filter of the invention.

FIG. 1 shows schematically a known embodiment of an adjustable capacitive susceptance. It comprises a waveguide 1 into which is inserted a metal screw 2 which is screwed into a tapped hole 5 situated in the plane of symmetry of the section of guide 1. Screw 2 comprises a slot 3 for screwing it in or out for adjusting the insertion distance, so that the end 6 of the screw projects slightly inside the wave-guide 1. The value of the susceptance is adjusted by screwing screw 2 in or out, then it is immobilized by means of a nut 4 screwed on to screw 2 and tightened against the external surface of the wave-guide.

Furthermore, it is known that a short-circuited coaxial line with one end has, at the other end, an inductive susceptance when the length L of the line is less than a quarter wavelength λ or slightly less than an uneven multiple of a quarter wavelength.

Figure 2:
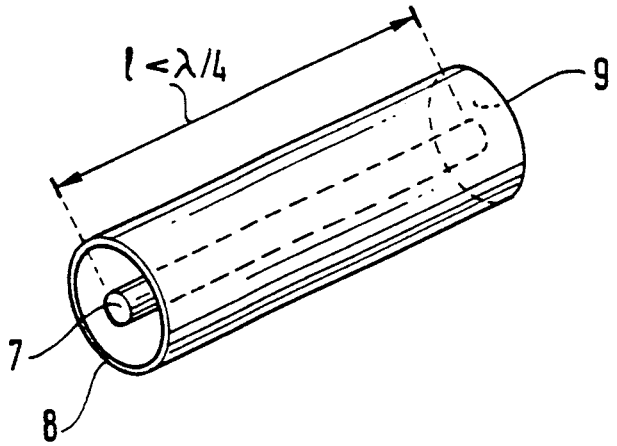
FIG. 2 PRIOR ART

FIG. 2 shows schematically a short-circuited coaxial line having an inner conductor 7 and an outer conductor 8 each with a cylindrical shape with circular cross section. The short-circuit element is formed by a metal plane 9 connecting conductors 7 and 8 to an end of the line. The susceptance of this line is adjustable by varying the length of the line.

The invention has consisted in combining these two known means to form a resonator rejecting a frequency band. But these means cannot be combined anyhow, without causing considerable disturbance of the propagation of the frequencies to let through.

Figure 3:
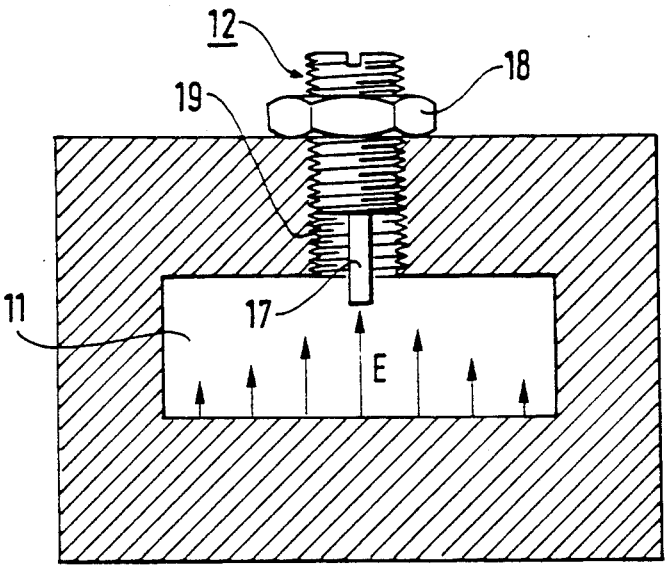
FIGS. 3 and 4 show schematically a first embodiment of the filter of the invention.
Figure 4:
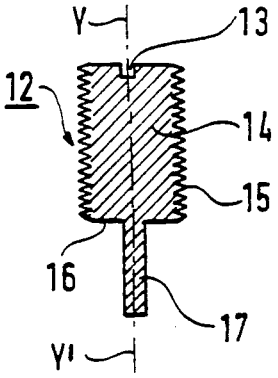

FIGS. 3 and 4 show a first embodiment of the filter according to the invention, comprising a single resonator and a wave-guide with rectangular cross section. A short-circuited coaxial line is formed by a tapped hole 19 and a screw 12 which is shown in cross section in FIG. 4. Hole 19 is formed in the largest side of guide 11, in the plane of symmetry thereof.

Screw 12 comprises : a slot 13 for screwing it in or out by means of a screwdriver, a threaded portion 14 having a thread 15 corresponding to the thread of hole 19, and a smooth portion 17 having a cylindrical shape with circular cross section and the same axis of symmetry YY' as portion 14, and extending the latter. Portion 17 has a length equal to an uneven multiple of a quarter wavelength corresponding to the central frequency of the frequency band to be rejected. In this example, it is exactly equal to a quarter wavelength. Portion 17 forms the inner conductor of a coaxial line with circular cross section and forms a bar plunging into guide 11. The outer conductor of the coaxial line is formed by the tapped hole 19, in the portion not occupied by screw 12. The length of the unoccupied portion of the tapped hole 19 is slightly less than a quarter wavelength and has an inductive susceptance.

At the junction of portions 14 and 17, a shoulder 16 forms a conducting plane short-circuiting the end of the coaxial line, the length of the outer conductor of this line is adjusted by screwing screw 12 in or out. The adjustment is such that the length of the line is slightly less than a quarter wavelength, consequently a part of portion 17 projects inside guide 11 and has a capacitive susceptance whose value also depends on the position of screw 12. A nut 18 is screwed on to screw 12 and is tightened against the external surface of the wave-guide for immobilizing screw 12 after it has been adjusted.

It should be noted that the end of portion 17 plunges into the interior of the guide 11 at the position where the electric field E is maximum. Its projection into the guide is small, which avoids greatly disturbing the propagation of the waves in guide 11.

Guide 11 may be formed very conventionally by extruding an aluminium alloy. The thickness of the wall must be sufficient for the unoccupied part of the tapped hole 19 to have a length close to a quarter wavelength corresponding to the central frequency of the frequency band to be rejected.

Screw 12 may be formed by machining a conventional brass screw, so as to reduce its diameter over a part of its length and form a shoulder 16. It may possibly be covered with a conventional electrolytic deposition, ending in a gold layer. The formation of the tapped hole 19 and screw 12 is therefore very simple with respect to the formation of cavities coupled by an iris, which conventional filters comprise. On the other hand, the size of screw 12 is much smaller than the size of a cavity coupled by an iris.

Several filters such as the one shown in FIG. 3 may be juxtaposed to form a filter providing greater attenuation of the frequency band to be rejected. Such a filter may comprise a plurality of identical shortcircuited coaxial lines aligned in a plane of symmetry of the guide, where the electric field is maximum. They are spaced apart by an uneven number of quarter wavelengths corresponding to the central frequency of the band to be let through.

Figure 5:
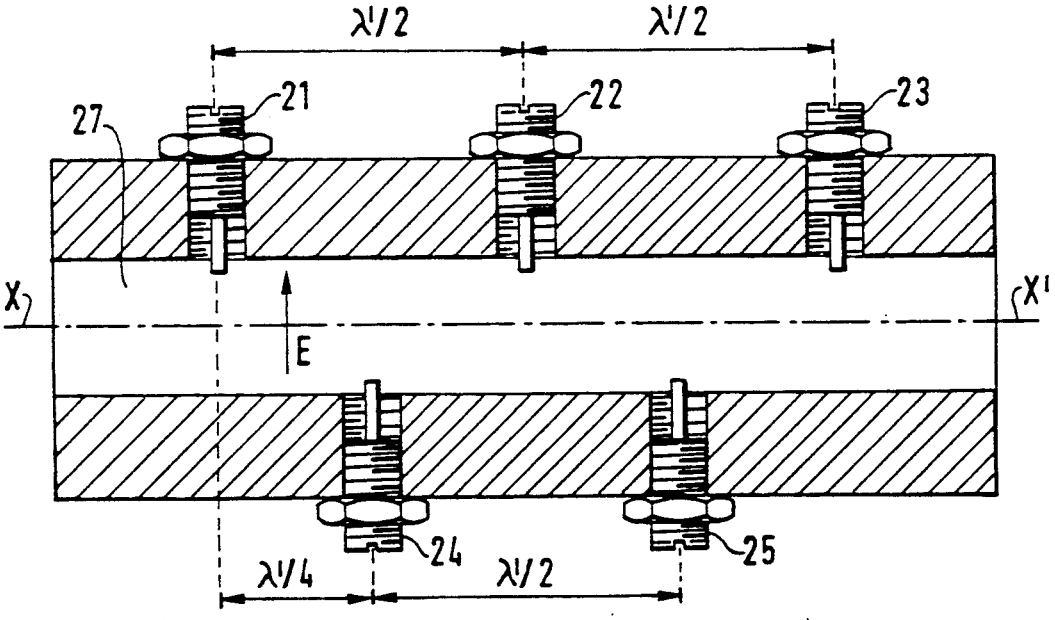
FIG. 5 shows schematically a second embodiment comprising several filter stages.

FIG. 5 shows schematically a second embodiment of the filter according to the invention, comprising five resonators similar to the one described above. Three resonators comprising screws 21 to 23 are situated on a first line and two resonators comprising two screws 24 and 25 are situated on a second line, these two lines being symmetrical with respect to the axis of symmetry XX' of wave-guide 27. These two lines are situated in a plane of symmetry of wave-guide 27 where the electric field vector E is maximum.

On the first line, as also on the second line, two successive resonators are spaced apart by half a wavelength λ' of the central frequency of a frequency band to be let through. The resonators situated on the first line are offset by a quarter wavelength with respect to the resonators situated on the second line. Screw 24 is situated half way between screws 21 and 22. Screw 25 is situated half way between screws 22 and 23. This arrangement of the resonators gives a transfer function with very low attenuation for the frequencies to be let through and a transfer function with attenuation proportional to the number of resonators, for the frequencies to be rejected. In this example, screws 21 to 25 have a diameter of 3 mm which is reduced to 0.63 mm in part 17 forming the inner conductor of the coaxial line. This part 17 has a length of 5.05 mm. With such dimensions, the coaxial line has a characteristic impedance of 96 ohms. The value of the characteristic impedance of the coaxial line determines in part the value of the coupling between the coaxial line and the waveguide and determines the overvoltage factor of the resonator, in other words determines the attenuation and the width of the attenuated band. The characteristic impedance of the coaxial line is given by the formula:

$$Zc = 138 \cdot \log \frac{b}{a}$$

where b is the internal diameter of the outer conductor of the coaxial line and where a is the diameter of the inner conductor. To obtain higher coupling or a maximum overvoltage coefficient, the characteristic impedance of the coaxial line may be between 60 and 100 ohms.

Figure 6:
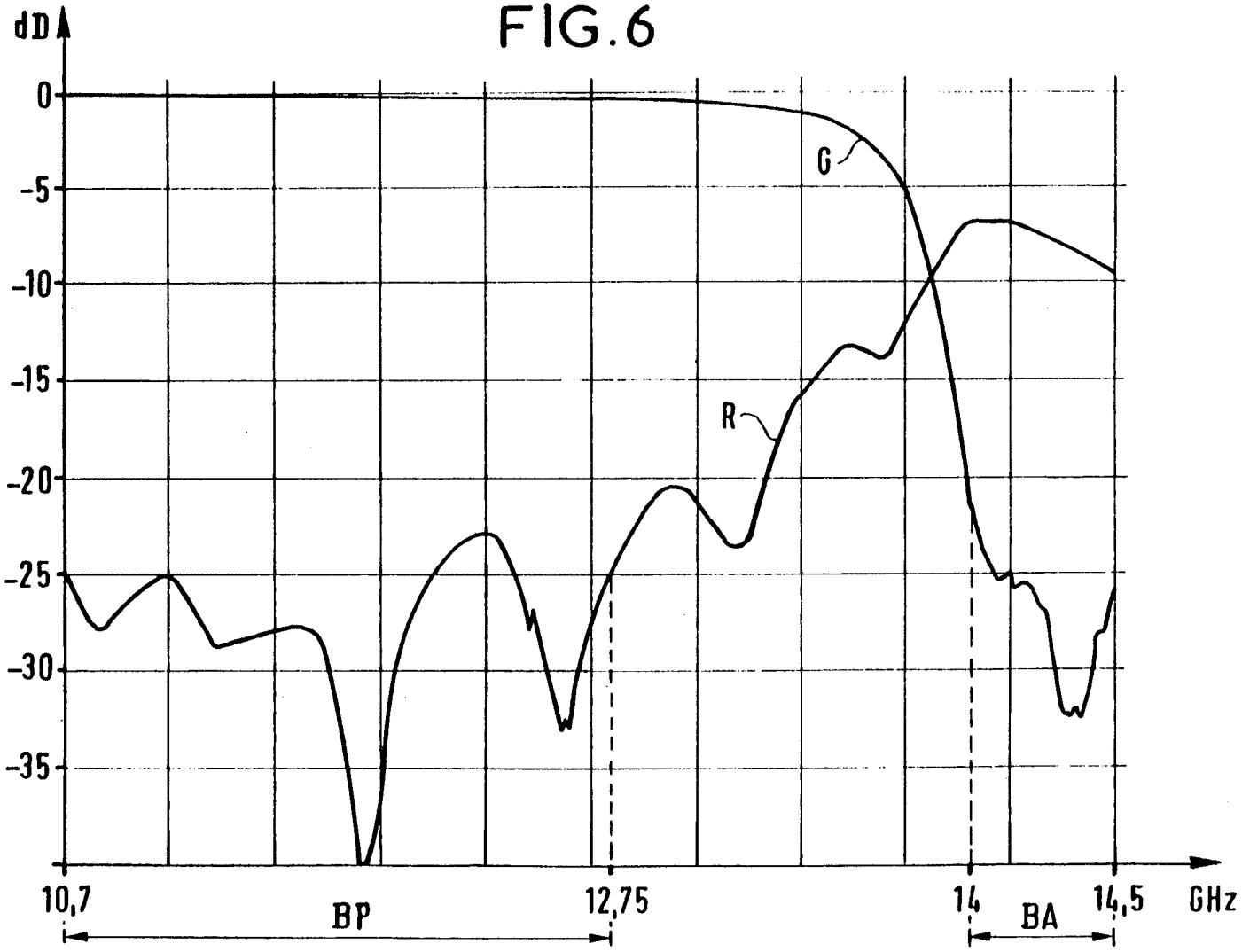
FIG. 6 shows the graph of the attenuation and the graph of the standing wave rate for the second embodiment of the filter of the invention.

FIG. 6 shows the graph G of the attenuation and graph R of the standing wave rate. For the embodiment shown in FIG. 5, used for rejecting the frequency band BA, from 14 to 14.5 GHz and to let through the frequency band BP from 10.7 to 12.785 GHz. It is apparent that attenuation of the 14 to 14.5 GHz band is greater than 20 dB and that the standing wave rate in the 10.7 to 12.75 GHz band expressed in absolute value is less than 1.15, whereas the insertion losses are less than 0.2 dB. These figures should be compared with the performances of a conventional filter formed of five cavities coupled to a wave-guide by irises. A conventional filter provides an attenuation, of the band to be rejected, greater than 50 dB and a standing wave rate in the passband less than 1.05. With insertion losses less than 0.05 dB. For the same number of resonators, the filter according to the invention has therefore more modest performances but, on the other hand, the cost price is about 3 to 4 times smaller and the size is greatly reduced.

The invention is not limited to the examples described above. Numerous variants are within the scope of a man skilled in the art, in so far as the construction of the coaxial line forming the resonator is concerned and in so far as its integration in a wave-guide of a microwave transmission - reception device is concerned.

Figure 7:
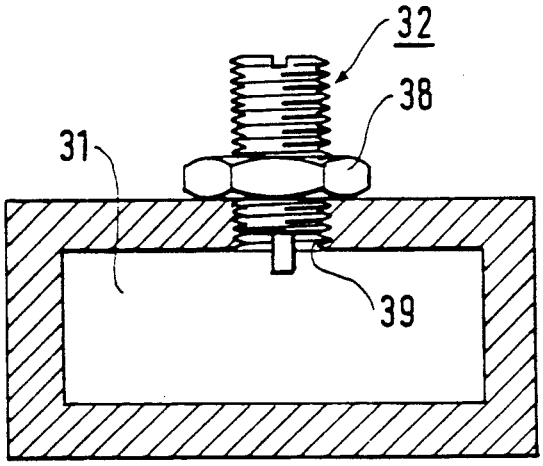
FIGS. 7 and 8 show a third embodiment.
Figure 8:
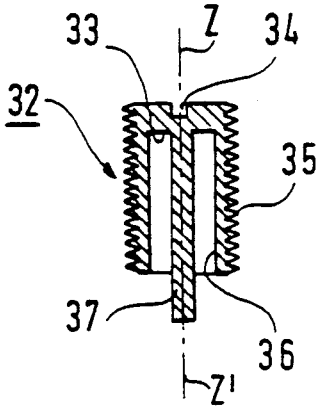

FIGS. 7 and 8 show a third embodiment of a filter according to the invention. This example comprises a single resonator formed essentially by a socket 32 screwed into a tapped hole 39 which is formed in the largest wall of a guide 31 with rectangular cross section. FIG. 8 shows socket 32 seen in section. The axis of symmetry ZZ' of socket 32 is situated in the plane of symmetry of guide 31. The outer surface of socket 32 comprises a screw thread 35 over the whole of its length. At the end of socket 32 situated outside guide 31 a slot 34 allows socket 32 to be screwed into or out of hole 39. A nut 38 screwed on to socket 32 immobilizes the socket 32 after its position has been adjusted so as to tune to the central frequency of the frequency band to be rejected.

Socket 32 is hollow. Its inside has a smooth cylindrical surface 36 and it contains a rod 37 having a cylindrical shape whose axis of symmetry of revolution merges with axis of symmetry of revolution ZZ' of socket 32. The diameter of rod 37 is less than the inner diameter of socket 32 and its length is equal to an uneven number of quarter wavelengths corresponding to the central frequency of the band to be rejected. In this example, the length of rod 37 is equal to a quarter wavelength. The length of rod 37 is greater than the depth of socket 32 so that rod 35 projects form the mouth of the socket.

When socket 32 is positioned in the tapped hole 39, the inside of the socket and a free portion of the tapped whereas rod 37 forms an inner conductor of this line and the end of rod 37 forms a plunger penetrating into the wave-guide 31 to form a capacitive susceptance connected to the end of a coaxial line. The bottom 33 of socket 32 has a flat surface orthogonal to the axis of symmetry ZZ', and forms a short-circuit element at the other coaxial line end. The length of socket 32 is less than a quarter wavelength so that the socket does not project inside guide 31, and so that a part of the tapped hole 39 is not occupied by socket 32 and forms a part of the coaxial line.

As is apparent from a comparison of FIGS. 3 and 7, the third embodiment makes it possible to use a guide section 31 having a wall of a thickness less than the length of the coaxial line to be formed whereas the first embodiment requires a wave-guide having a wall thickness greater than the length of the coaxial line to be formed.

Figure 9:
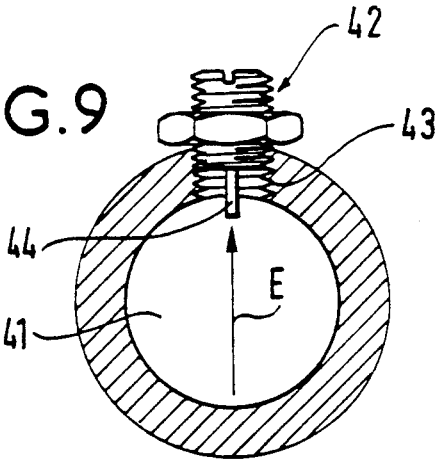
FIG. 9 shows schematically a fourth embodiment for a wave-guide with circular cross section.

FIG. 9 shows a fourth embodiment of a filter according to the invention comprising a resonator 42 formed by a socket, similar to socket 32 described above, screwed into a tapped hole 43 which is formed in the wall of a wave-guide 41 with circular cross section. Conductor 44 of the short-circuited coaxial line has its large axis which passes through the center of the guide and is parallel to the electric field E of the waves to be rejected.

Figure 10:
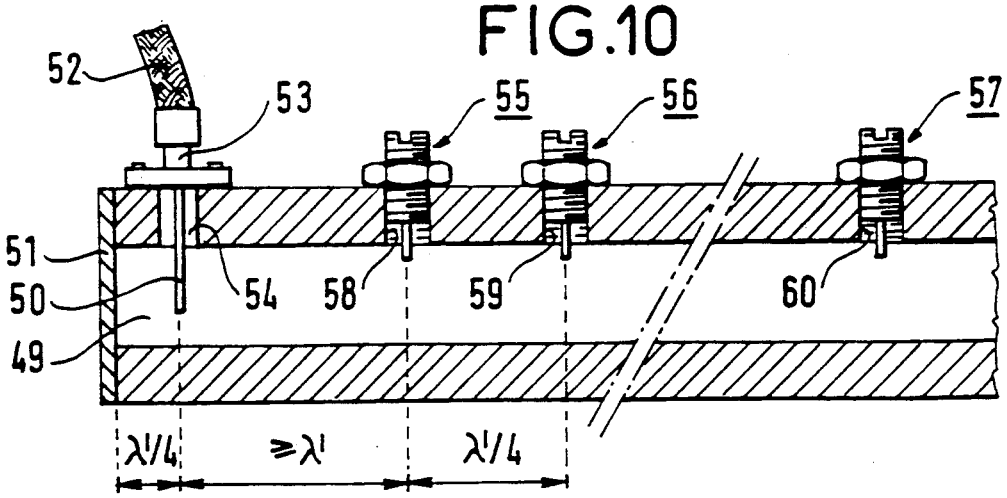
FIG. 10 shows a fifth embodiment of the filter of the invention, combined with a coaxial cable - wave-guide transition.

FIG. 10 shows a fifth embodiment of a filter according to the invention which is combined with a coaxial cable —wave-guide transition. This transition comprises a wave-guide 49, with rectangular cross section, closed by a metal plate 51 and comprises an antenna 50 plunging into guide 49. Antenna 50 is connected to the central conductor of a coaxial cable 52 by a coaxial connector 53. Antenna 50 passes through a hole 54 formed in the wall of guide 49, on its large side, and in its plane of symmetry. This transition also forms a band rejection filter comprising a plurality of resonators formed by sockets 55 to 57 screwed into tapped holes 58 to 60. These sockets 55 to 57 are similar to the socket 32 described above. Antenna 50 is placed at a distance equal to a quarter wavelength λ' corresponding to the central frequency of the band to be let through, with respect to the metal plate 51 closing the wave-guide. The nearest resonator 55 is placed at a distance at least equal to the wavelength λ' corresponding to the central frequency of the band to be let through, with respect to antenna 50. The other resonators are situated at regular intervals, equal to uneven multiples of a quarter wavelength λ' corresponding to the central frequency of the band to be rejected. For example, the intervals are all equal to a quarter wavelength.

We claim:

1. In a band rejection filter for a microwave wave-guide, comprising:

a wave-guide (11);

at least one short-circuited coaxial line comprising an inner conductor (17) and an outer conductor (19) which are coaxial and spaced radially from each other, the inner conductor (17) having a length equal to an odd multiple of a quarter wavelength corresponding to a central frequency of a frequency band to be rejected, and plunging into an interior of the wave-guide (11) for being coupled to an electric filed (E), and the outer conductor (19) having a length less than said odd multiple, the improvement comprising: said outer conductor being formed, at least partially, by a cylindrical tapped hole (19) formed in a conductive wall of the wave-guide (11) and spaced radially from said inner conductor and whose electric length is adjustable by a short-circuit element (16; 33) which can be screwed into said tapped hole leaving a variable length of said tapped hole free of said short circuit element.

2. Filter according to claim 1, wherein the inner conductor of the short-circuited coaxial line comprises a metal screw (12), screwed into the tapped hole (19) and comprising a cylindrical extension (17) having an axis of symmetry of revolution common to that of the screw (12) but with a smaller diameter constituting said inner conductor, said screw (12) forming said short-circuit element at an end of the coaxial line.

3. Filter according to claim 1, wherein the short-circuited coaxial line outer conductor further comprises a cylindrical externally threaded, hollow socket (32), having a smooth inside, which is closed at one end by a conducting plane (33) forming said short-circuit element for the coaxial line, said conducting plane (33) carrying a coaxial cylindrical conductor (37) constituting said inner conductor, and said hollow socket being screwed in the tapped hole (39).

4. Filter according to claim 1, wherein said at least one short-circuited coaxial line comprises a plurality of identical short-circuited coaxial lines (55 to 57) aligned and spaced apart by an odd number of quarter wavelengths corresponding to the central frequency of a frequency band to be let through.

5. Filter according to claim 1, wherein said waveguide has a longitudinal axis of symmetry (XX') and said at least one short-circuited coaxial line comprises a plurality of first identical short-circuited coaxial lines (21 to 23), aligned and spaced apart by an odd number of half wavelengths corresponding to the central frequency of a frequency band to be let through, and a plurality of second identical short-circuited coaxial lines (24 to 25), aligned and spaced apart by an odd number of half wavelengths corresponding to the central frequency of a frequency band to let through, the first and second coaxial lines being disposed on opposite sides of the axis of symmetry (XX') of the waveguide (27).

6. Wave-guide band rejection filter having a coaxial tuning screw, comprising:

a wave-guide (11), at least one cylindrical tapped hole (39) extending into a wall of said wave-guide and opening to the interior of said wave-guide;

at least one short-circuited coaxial line comprising a cylindrical externally threaded, hollow socket (32), smooth on the inside and being closed at one end by a conducting plane (33) forming a short-circuit element for the coaxial line, said conducting plane (33) carrying a coaxial cylindrical conductor (37) forming an inner conductor of the coaxial line, having a length equal to an odd multiple of a quarter wavelength corresponding to a central frequency of a frequency band to be rejected, and plunging into the interior of the wave-guide (11) for being coupled to an electric field (E); an inside of the hollow socket (32) and a part of the tapped hole (39) free of said socket forming an outer conductor for the coaxial line, whereby the length of said outer conductor is adjusted by screwing/unscrewing said socket (32) axially into said tapped hole (39).

* * * * *